United States Patent [19]

Yoshioka et al.

[11] 4,059,741

[45] Nov. 22, 1977

[54] PUFFER TYPE GAS CIRCUIT BREAKER

[75] Inventors: Yoshio Yoshioka; Kunio Hirasawa; Masanori Tsukushi, all of Hitachi, Japan

[73] Assignee: Hitachi, Ltd., Japan

[21] Appl. No.: 660,787

[22] Filed: Feb. 24, 1976

[30] Foreign Application Priority Data

Mar. 10, 1975 Japan ..... 50-28049

[51] Int. Cl.[2] ..... H01H 33/70

[52] U.S. Cl. ..... 200/148 A; 200/150 G; 200/148 D

[58] Field of Search ..... 200/148 A, 150 G, 148 D, 200/148 R

[56] References Cited

U.S. PATENT DOCUMENTS

| | | | |
|---|---|---|---|
| 2,981,814 | 4/1961 | Friedrich | 200/148 D |
| 3,721,786 | 3/1973 | Yoshioka | 200/148 A |

*Primary Examiner*—Robert S. Macon
*Attorney, Agent, or Firm*—Craig & Antonelli

[57] ABSTRACT

Two puffer type circuit breaking units are symmetrically disposed with respect to a bracket interposed therebetween. Linking means are mounted in the bracket, and one end of the linking means is connected to movable parts of the puffer type circuit breaking units and the other end is connected to operating means through an electrically insulated operating rod. An electromagnetic coil is disposed in the bracket and an electromagnetic repulsive member is electromagnetically connected to the electromagnetic coil to produce an electromagnetic repulsive force. During the breaking operation, current transferring means mounted in the puffer type breaking units are actuated to apply an electric current to the electromagnetic coil, and an electromagnetic repulsive force is imposed on the electromagnetic repulsive member to actuate the movable parts of the puffer type breaking units together with the operating means, whereby the breaking of a large current is made possible. Since the current transferring means are disposed in the breaking units, the structure of the current transferring means is simplified and construction thereof is facilitated and transfer of an electric current to the electromagnetic coil can be performed assuredly.

8 Claims, 9 Drawing Figures

PUFFER TYPE GAS CIRCUIT BREAKER

BACKGROUND OF THE INVENTION

1. Field of the Invention

This invention relates to a puffer type gas circuit breaker and, more particularly, the invention relates to a puffer type gas circuit breaker of a large capacity in which a pair of circuit breaking units are connected in series with each other.

2. Description of the Prior Art

A puffer type gas circuit breaker has a simple structure and it is advantageous in that since a low pressure can be adopted for $SF_6$ gas to be used as the insulating medium, the $SF_6$ gas does not become liquefied. However, it is defective in that when a large current such as exceeding 50 KA is broken, a very high operating force is required. The capacity of power-transmission lines has recently been increased with an increase in the demand for electric power, and the intensity of electric current to be broken by the breaker also increases. Accordingly, the operating force for operating the puffer type gas circuit breaker has to be increased. As a means for solving this problem, there has to been developed a puffer type gas circuit breaker in which an electromagnetic force is produced by a breaking current flowing in breaking units and this electromagnetic force is utilized as the operating force. In these conventional puffer type gas circuit breakers utilizing an electromagnetic force as the operating force, an electromagnetic actuating unit is mounted for each of the breaking units, respectively, and therefore, the structure is complicated.

As a means for overcoming this disadvantage, there has been proposed a circuit breaker in which a conventional puffer type gas circuit breaker unit of a simple structure is utilized for each of at least 2 breaker units having breaker points and an electromagnetic actuating device is disposed from the outside in the middle of the operating mechanism (see copending U.S. application Serial No. 520,906, filed November 4, 1974, and assigned to the assignee of the present application.) In this previous proposal, however, since the current transferring means for applying an electric current to the electromagnetic actuating device is arranged at a part where the electromagnetic actuating device is disposed, there is brought about a defect that the structure of the electromagnetic actuating device has to be complicated to some extent.

SUMMARY OF THE INVENTION

It is a primary object of the present invention to provide a puffer type gas circuit breaker which can easily interrupt a large current. In order to attain this object, an electromagnetic actuating device is disposed so that by causing electric current to be interrupted to this electromagnetic actuating device at the breaking of the electric current, an electromagnetic force is produced to actuate the movable parts of breaking units.

Another object of the present invention is to provide a puffer type gas circuit breaker in which the structure of the electromagnetic actuating device is simplified.

Still another object of the present invention is to provide a puffer type gas circuit breaker in which at the breaking of current, the current to be interrupted can flow to the electromagnetic actuating device assuredly.

In accordance with the present invention, there is provided a puffer type gas circuit breaker comprising at least a pair of puffer type breaking units having their movable parts disposed facing each other, each breaking unit including at least a pair of contacts capable of being opened and separated, and a puffer device having a puffer cylinder and a puffer piston and being disposed so that when said contacts are opened and separated, an arc-extinguishing gas is compressed and is blown into the arc produced between the contacts. A bracket is disposed between the puffer type breaking units and insulating and supporting means are provided for supporting the bracket in a state electrically insulated from ground potential. Linking means are mounted on the bracket to transmit an actuating force to each of the movable parts of the puffer type breaking units. An electrically insulated operating rod connects the linking means with the operating means disposed at the ground potential portion in the insulated state. Supporting means support each of the puffer type breaking units to the bracket. Insulating connecting means connect the movable parts of the puffer type breaking units with the linking means in the insulated state. An electromagnetic coil attached in the insulated state to the bracket forms a series connecting circuit with each of the puffer type breaking units. An electromagnetic repulsive member electromagnetically connected to the electromagnetic coil is arranged to actuate the linking means to open the puffer type breaking units in proportion to the intensity of an electric current flowing through the electromagnetic coil. Current transferring means are mounted on the puffer type breaking units to short-circuit the electromagnetic coil at closing positions of the puffer type breaking units and release this short circuit at the initial stage of the breaking operation.

DETAILED DESCRIPTION

Figure 1:
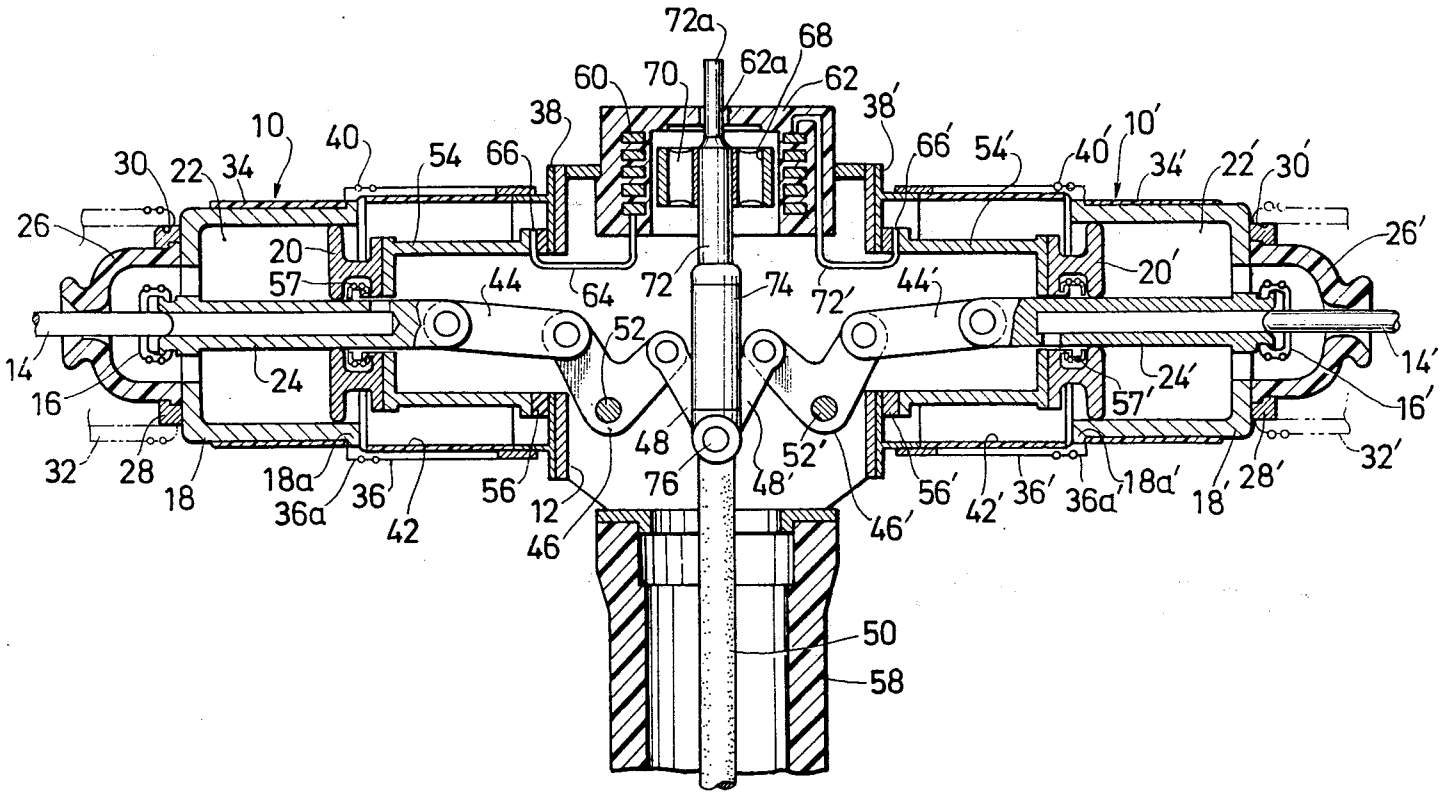
FIG. 1 is a sectional view showing the closed state of breaking units of a puffer type gas circuit breaker according to one embodiment of the present invention.

Referring now to FIG. 1 showing one embodiment of the present invention, a pair of puffer type breaking units 10 and 10' are symmmetrically disposed with a bracket 12 interposed therebetween. These breaking units will now be described mainly by reference to the puffer type breaking unit 10. A fixed contact 14 and a movable contact 16 are disposed so that the movable contact 16 can be contacted and be separated from the fixed contact 14. This movable contact 16 is fixed to a puffer cylinder 18, and a puffer chamber 22 is constructed by this puffer cylinder 18 and a puffer piston 20. When the puffer cylinder 18 is actuated by operation of a puffer cylinder shaft 24, an arc-extinguishing gas such as $SF_6$ is compressed at a high pressure. This compressed arc-extinguishing gas is blown to an arc produced between the fixed contact 14 and the movable contact 16 to extinguish the arc. The arc-extinguishing gas is guided by an electrically insulated nozzle 26 mounted on the puffer cylinder 18 to act effectively on the arc. The electrically insulated nozzle 26 is fixed to the puffer cylinder 18 by an electrically insulated nozzle fitting 28. The peripheral face of the nozzle fitting 28 acts as a movable current contact 30 when the current passing through the breaker increases, and a fixed current contact 32 is disposed so that the contact 30 can be contacted with and separated from the contact 32.

Figure 2:
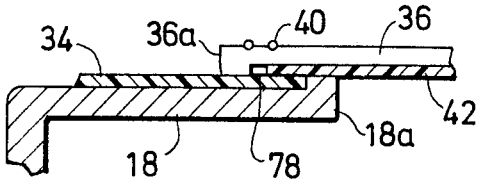
FIG. 2 is a partially enlarged sectional view of current transferring means during the breaking operation in the embodiment shown in FIG. 1.

An insulator 34 is formed on the peripheral face of the puffer cylinder 18 with a contact area 18*a*. The contact area 18*a* is arranged so that the top end 36*a* of a contact 36 falls in contact therewith. The contact 36 is fixed to a terminal 38 fixed to the bracket 12. A spring 40 is wound on the peripheral portion of the top end 36*a* of the contact 36 to press the top end 36*a* of the contact 36 against the contact area 18*a* of the puffer cylinder 18. An insulator 42 is disposed on the inner face of the contact 36, so that when the puffer cylinder 18 is moved to a pass-opening direction, the insulator 42 faces the insulator 34 with a slight clearance left therebetween as shown in FIG. 2.

The terminal portion of the puffer cylinder shaft 24 is connected to a link 46 through an electrically insulated rod 44, and the other end of the link 46 is connected to an electrically insulated operating rod 50 through a lever 48. The link 46 is attached to the bracket 12 by a shaft 52 so that it rotates with the shaft 52 being the fulcrum. The puffer piston 20 is supported by a puffer piston stand 54, and the stand 54 is fixed to the bracket 12 through an insulator 56 and the stand 54 is electrically insulated from the bracket 12. A contact 57 to be contacted with the puffer cylinder shaft 24 is mounted on the base of the puffer piston 20.

The bracket 12 is supported in a state insulated from the ground potential portion by an electrically insulating cylinder 58, and the electrically insulated operating rod 50 penetrates through this insulating cylinder 58 and is actuated by operating means (not shown) disposed on the ground potential portion. On the side of the bracket 12 opposite the side where the insulating cylinder 58 is disposed, an electromagnetic coil 60 is attached integrally by a molded insulator 62. The electromagnetic coil 60 is connected with a terminal 66 formed on the puffer piston stand 54 through a conductor 64. An electromagnetic repulsive member 60 is mounted in the hollow portion of the electromagnetic coil 60. This electromagnetic repulsive member 68 is composed of a short circuit ring or short circuit coil. The electromagnetic repulsive member 68 is electrically connected to the coil 60, so that when electric current passes through the electromagnetic coil 60, an electromagnetic repulsive force is produced by the electromagnetic repulsive member 68. The electromagnetic repulsive member 68 is mechanically connected to a central rod 72 by a rib 70, and this central rod 72 is mechanically connected to a connecting member 74 and this connecting member 74 is connected to the electrically insulated operating rod 50 at a connecting point 76. The top end 72a of the central rod 72 penetrates through a hole 62a perforated on the molded insulator 62 and acts as a guide for maintaining a specified clearance between the electromagnetic repulsive member 68 and the electromagnetic coil 60.

The foregoing illustration has been made with reference to the puffer type breaking unit 10, but as is apparent to those skilled in the art, the other puffer type breaking unit 10' disposed symmetrically with the breaking unit 10 with respect to bracket 12 interposed therebetween has the same structure as described above. Structural members of the breaking unit 10' which are the same as or corresponding to the above illustrated structural members of the breaking unit 10 are indicated by the same reference numerals, with a prime placed after each reference numeral.

Both breaking units are arranged in a grounded tank (not shown) which is connected to ground potential and which is filled with an insulating medium such as $SF_6$ gas.

The operation of the puffer type gas circuit breaker having the above structure will now be described.

In the closed state shown in FIG. 1, current passes through a circuit of fixed contact 14 - movable contact 16 - puffer cylinder 18 - contact 36 - terminal 38 - bracket 12 - terminal 38'- contact 36'- puffer cylinder 18' movable contact 16'- fixed contact 14'. In this case the terminal 38 may be short-circuited to the terminal 38' without passing through the bracket 12 by provision of a suitable conductor.

The breaking operation will now be described. The electrically insulated operating rod 50 is pulled down by the external operating means (not shown), whereby the puffer cylinder shaft 24 of the puffer type breaking unit 10 is driven to the right through lever 48, link 46 and insulating rod 44. Simultaneously, the puffer cylinder shaft 24' of the puffer type breaking unit 10' is driven to the left. By this movement of the puffer cylinder shafts 24 and 24', the arc-extinguishing gas in the puffer chambers 22 and 22' is compressed and the movable contacts 16 and 16' are opened and separated from the fixed contacts 14 and 14'. The high pressure arc-extinguishing gas produced in the puffer chambers 22 and 22' are guided by the electrically insulated nozzles 26 and 26' and blown to arcs produced between the contacts 16 and 14 and between the contacts 16' and 14'. By this breaking operation, the puffer cylinders 18 and 18' are shifted to break contacts between the contact areas 18*a* and 18*a'* of the puffer cylinders 18 and 18' and the contacts 36 and 36'. This state is illustrated in FIG. 2. An arc 78 produced between the contact area 18*a* and the contact 36 is drawn to between insulators 34 and 42 composed of polytetrafluoroethylene or a similar material, whereby currents flowing from the puffer cylinders 18 and 18' to contacts 36 and 36' are broken.

Figure 3:
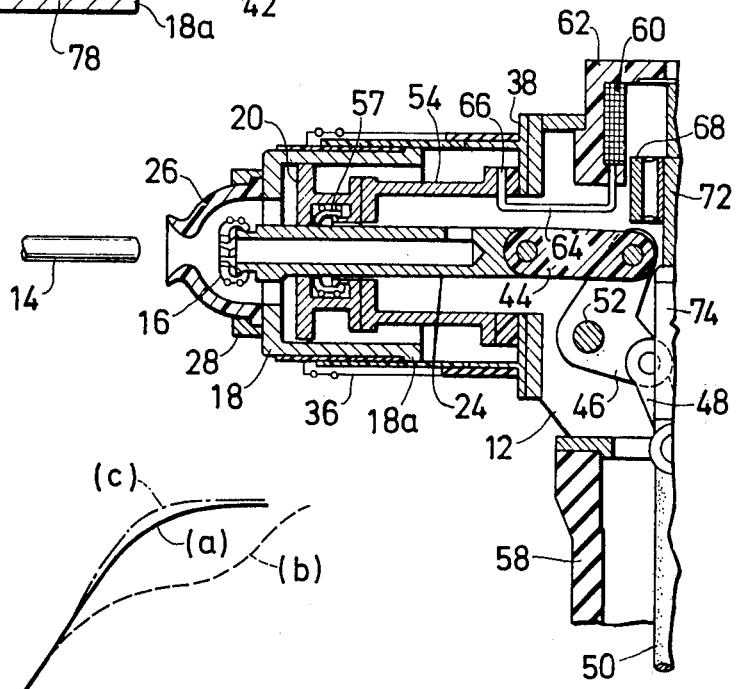
FIG. 3 is a partial view showing the opened state in the embodiment shown in FIG. 1.

By the above breaking operation, the current is caused to flow through a course of movable contact 16 - puffer cylinder shaft 24 - contact 56 - puffer piston 18 - puffer piston stand 54 - conductor 64 - electromagnetic coil 60 - conductor 64'- puffer piston stand 54'- puffer piston 18'- contact 56' - puffer cylinder shaft 24'- movable contact 16'. Accordingly, the electromagnetic coil 60 is excited and the electromagnetic repulsive member 68 electromagnetically connected to the electromagnetic coil 60 is urged downwardly by a strong force. This electromagnetic force is transmitted to the levers 48 and 48' through ribs 70, central rod 72 and connecting member 74, whereby the puffer cylinders 18 and 18' are driven by a strong force to drastically increase the pressures inside the puffer chambers 22 and 22'. Accordingly, a further elevated pressure-arc-extinguishing gas is blown to each of the arcs produced between the contacts 14 and 16 and between 14' and 16', and hence, the arcs are extinguished to interrupt a large current. This state is illustrated in FIG. 3. A very large electromagnetic force is imposed between the electromagnetic coil 60 and the electromagnetic repulsive member 68 when the large current is interrupted. Accordingly, the electromagnetic coil 60 is tightly held against the bracket 12 by the molded insulator 62. If desired, this molded insulator 62 may be reinforced by a non-magnetic material such as iron or steel or a material of a low electric conductivity.

The operation of converting the opened state shown in FIG. 3 to the closed state shown in FIG. 1 will now be described. By driving upwardly the electrically insulated operating rod 50 by the external operating means (not shown), the puffer cylinder shaft 24 is moved to the left and the puffer cylinder shaft 24' is moved to the right, whereby contacts 14 and 14' are contacted again with the contacts 16 and 16', respectively and the closing operation is completed to restore the state shown in FIG. 1.

In the foregoing embodiment, a conventional puffer type breaking unit can be used for each of the breaking units without any substantial modification. More specifically, a conventional puffer type breaking unit can be used after making the following minor modifications. Insulators 34 and 34' are formed on the peripheries of the puffer cylinders 18 and 18', insulators 42 and 42' are formed on the inner faces of contacts 36 and 36', puffer piston stands 54 and 54' are insulated from the bracket 12 by insulators 42 and 42', and puffer cylinder shafts 24 and 24' are connected to links 46 and 46' through electrically insulated rods 50 and 50'. Accordingly, the structure of each of the breaking units 10 and 10' is hardly different from the structure of the conventional breaking unit and the structure is very simple.

Figure 4:
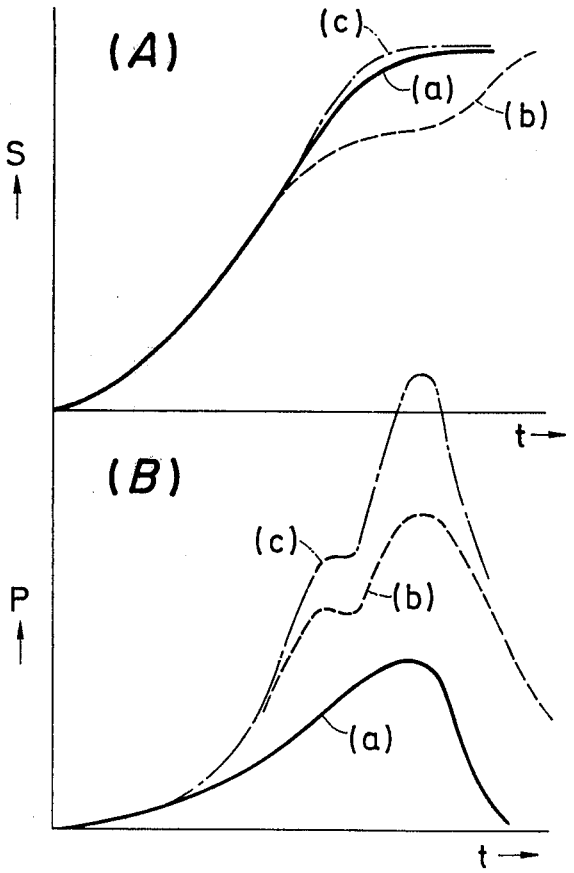
FIG. 4 is a characteristic curve illustrating the relationship of the stroke and puffer pressure to lapse of time.

In FIG. 4, the stroke characteristic (A) and puffer pressure characteristic (B) of the breaker of the foregoing embodiment are compared with those of the conventional breaker. In FIG. 4, the ordinate denotes stroke S and puffer pressure P and the abscissa denotes time t.

The stroke and puffer pressure characteristics of the conventional breaker and the breaker of the foregoing embodiment observed when the current is not interrupted are indicated by curves (a). When a large current is interrupted, in the conventional breaker the puffer pressure is elevated by the influence of the arc as indicated by curve (b) and hence, the stroke increases stepwise as indicated by curve (b). Accordingly, the positional relation between the fixed contact and the nozzle is worsened and therefore, the breaking capacity is inevitably limited.

In contrast, in the foregoing embodiment according to the present invention, since a strong electromagnetic force acts between the electromagnetic coil 60 and the electromagnetic repulsive member 68 and this force is in turn imposed on the connecting point 76 between the electrically insulated operating rod 50 and lever 48, the breaking speed is enhanced as indicated by curve (c) in FIG. 4 and a temporary stagnation of the stroke as caused in the conventional breaker as indicated by curve (b) is not caused at all and, as indicated by curve (c), the puffer pressure is drastically elevated and provides a significant improveent of the breaking property together with the improved stroke characteristic.

Figure 5:
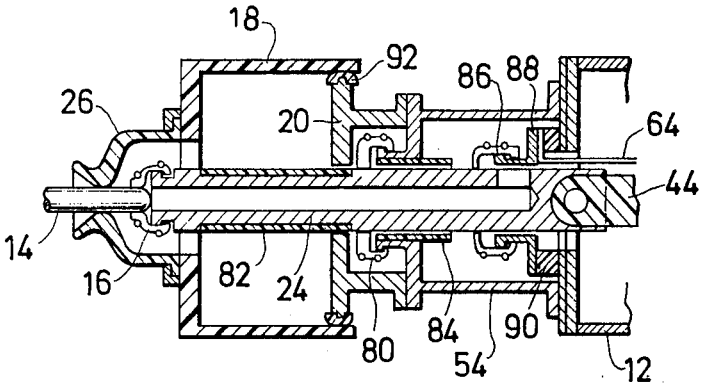
FIG. 5 is a sectional view showing the closed state of the breaking units of the puffer type gas circuit breaker according to another embodiment of the present invention.

FIG. 5 illustrates another embodiment of the current transferring means with the closed state shown in the figure. In this embodiment, the puffer piston stand 54 is directly attached to the bracket 12, and the puffer piston stand 54 is electrically connected to a contact 80. An insulator 82 is disposed on the periphery of the puffer cylinder shaft 24 on the side of the movable contact 16 to be contacted with said contact 80. On the puffer piston stand 54 there is disposed an insulator 84 so that it faces the insulator 82 with a slight clearance therebetween when the current is interrupted. Another contact 86 contacts with the puffer cylinder shaft 24 and a supporting stand 88 for the contact 86 is attached to the bracket 12 through an insulator 90. The conductor 64 connected to the electromagnetic coil 60 is connected to this supporting stand 88. The puffer cylinder 18 is electrically insulated from the puffer piston 20 by an insulator 92 mounted on the puffer piston 20.

In the foregoing structure, when the breaking unit is kept in the closed state, the current flows through fixed contact 14, movable contact 16, puffer cyliner shaft 24 contact 80 and puffer piston stand 54 and it is transferred from the bracket 12 to the other breaking unit (not shown).

When the current is interrupted, the puffer cylinder shaft 24 is moved to the right and the contact between the contact 80 and the puffer cylinder shaft 24 is broken by insulators 82 and 84. Although an arc is produced between the puffer cylinder shaft 24 and the contact 80, this arc is promptly extinguished between the insulators 82 and 84, whereby the current is caused to flow to the electromagnetic coil 60 through puffer cylinder shaft 24 - contact 86 - supporting stand 88 - conductor 64. The subsequent operation is the same as in the embodiment shown in FIG. 1 and therefore, its explanation will be omitted.

In this embodiment, it is necessary that the contact 86 be disposed at such a position that the puffer cylinder shaft 24 is not allowed to fall in contact with the insulator 82 even when the puffer cylinder shaft 24 is shifted to the rightwardmost position.

Figure 6:
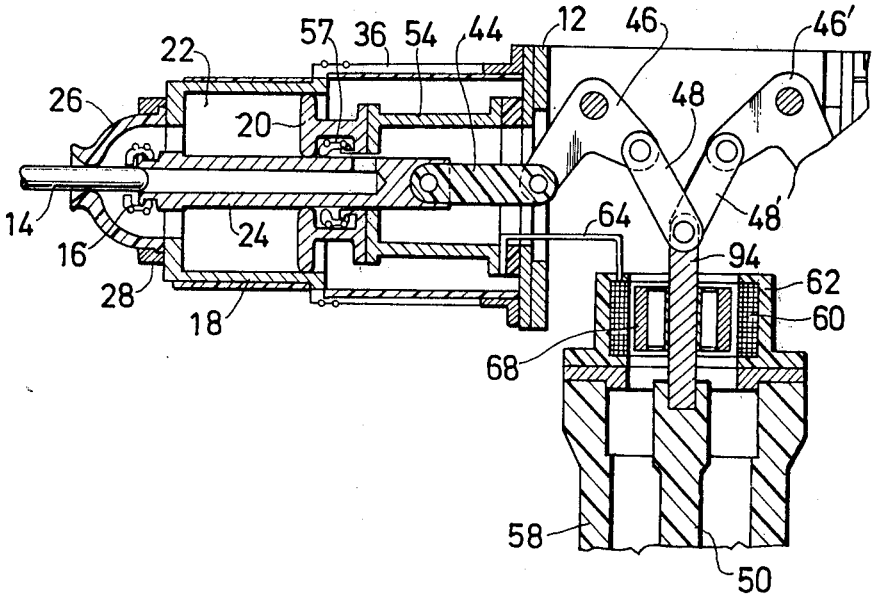
FIG. 6 is a sectional view showing the closed state of breaking units of the puffer type gas circuit breaker according to still another embodiment of the present invention.

FIG. 6 illustrates still another embodiment in which the position of the electromagnetic coil 60 and the linking means are changed. The molded insulator 62 integrated with the electromagnetic coil 60 is mounted on the bracket 12 on the side of the insulating cylinder 58. The electromagnetic repulsive member 68 electrically connected with the electromagnetic coil 60 is fixed to the central rod 94 disposed between the levers 48 and 48' and the electrically insulated operating rod 50. Links 46 and 46' are disposed in directions reverse to those in the embodiment of FIG. 1. In this embodiment, the breaking operation is effected by pushing upwardly the electrically insulated operating rod 50. The other structure and operation are the same as in the embodiment of FIG. 1. When current flows in the electromagnetic coil 60, the electromagnetic repulsive member 60 drives the central rod 94 upwardly. In this embodiment, since the electromagnetic coil 60 is disposed on the side of the insulating column 58, the repulsive force produced when the electromagnetic coil 60 is energized can easily be maintained.

Figure 7:
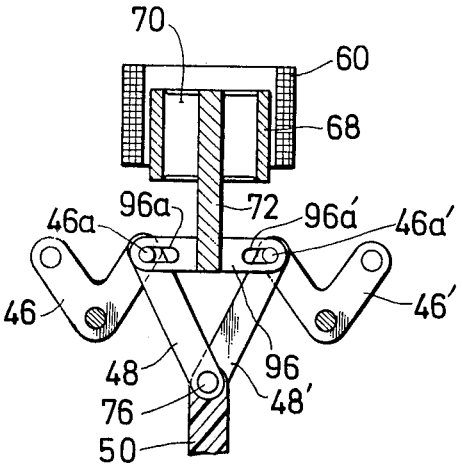
FIGS. 7 and 8 are sectional views showing the closed state of linking means of the puffer type gas circuit breaker according to a further embodiment of the present invention.

FIG. 7 illustrates another embodiment of the linking means. In the embodiment shown in FIG. 1 the linking means are arranged so that an electromagnetic force produced by the electromagnetic repulsive member 68 is imposed on the connecting point 76. In contrast, in the embodiment shown in FIG. 7, links 46 and 46' are directly driven by the electromagnetic force of the electromagnetic repulsive member 68. More specifically, the central rod 72 is connected to a lever 96, and connecting pins 46a and 46a' mounted on links 46 and 46' are inserted into oval holes 96a and 96a' of this lever 96. By this arrangement the links 46 and 46' are directly driven by the electromagnetic force of the repulsive member 68.

Figure 8:
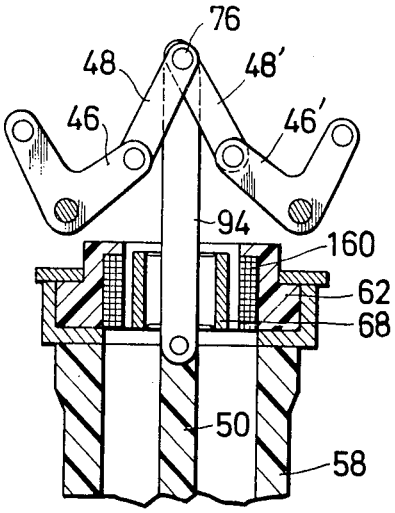

FIG. 8 illustrates a modification of the embodiment shown in FIG. 6 where links 46 and 46' are disposed in directions reverse to those shown in FIG. 6. The breaking operation is accomplished by driving the electrically insulated operating rod 50 downwardly. When current flows in the electromagnetic coil 60, the electromagnetic repulsive member 68 is energized to produce a downward electromagnetic force.

Figure 9:
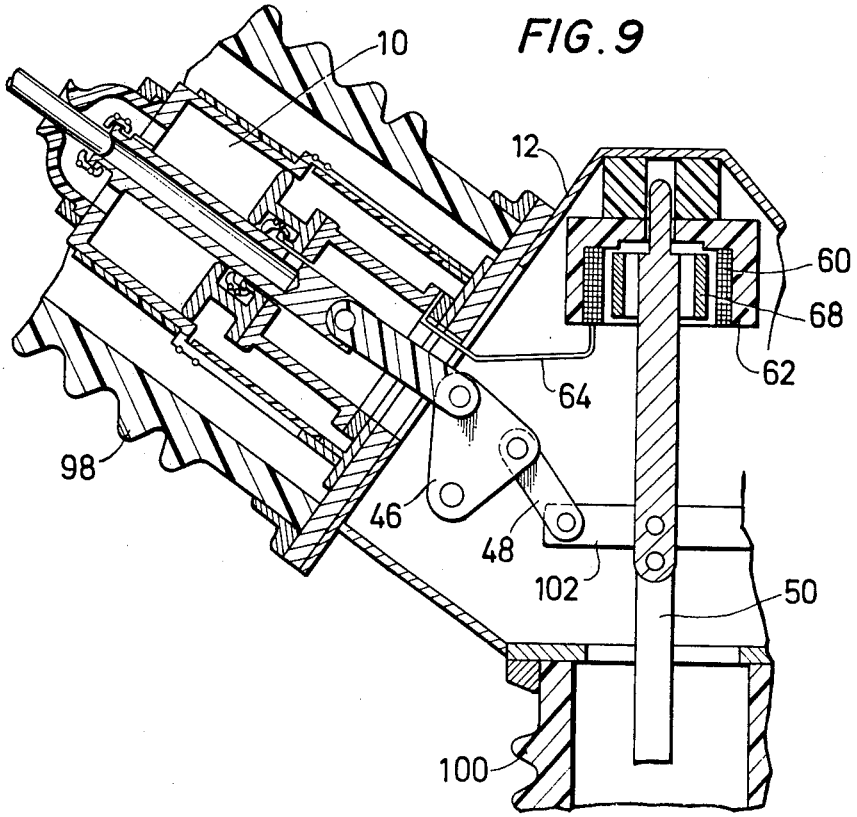
FIG. 9 is a partial sectional view showing the puffer type gas circuit breaker according to a further embodiment of the present invention.

FIG. 9 illustrates an embodiment in which the present invention is applied to a breaker of the insulator type. The puffer type breaking unit 10 is contained in an insulator tube 98 and the insulator tube 98 is fixed to the bracket 12 which is supported by a supporting insulator tube 100. These insulator tube 98, bracket 12, and supporting insulator tube 100 are air-tight and $SF_6$ gas fills the interiors of these members 98, 12, and 100. It is possible to mount an air-tight case covering the bracket 12 without providing an air-tight structure for the bracket 12. The central rod 72 is connected with a lever 102 and the lever 48 is connected to the top end of this lever 102. The structure of the puffer type breaking unit in this embodiment is the same as the structure of the breaking unit shown in FIG. 1. Accordingly, an explanation thereof is omitted. In FIG. 9 only one puffer type breaking unit 10 is shown, but as will be apparent to those skilled in the art, another puffer type breaking unit is disposed symmetrically with the breaker unit 10. In this embodiment, the assembly including the supporting insulator tube 100, bracket 12, and insulator tube 98 is arranged to have a Y-shaped configuration. Thus, it will readily be understood that not only a T-shaped configuration as shown in FIG. 1 but also a Y-shaped or other configuration can be adopted in the present invention.

The puffer type gas circuit breaker of the present invention having the above illustrated structure is advantageous over conventional puffer type gas circuit breaker in that a much larger current can be interrupted and the structure can be simplified. Further, the load of the movable parts imposed on the breaking unit can be greatly reduced, and the breaking operation can be performed smoothly without hindrance even when such a small current as not allowing the use of an electromagnetic force is to be interrupted. Moreover, since two current transferring means for exciting the electromagnetic coil are disposed in series, excitation of the electromagnetic coil can be accomplished assuredly at the initial stage of the breaking operation.

The foregoing embodiments are only illustrative of the present invention and by no means limit the scope of the invention, and further modifications will be apparent from these embodiments.

While we have shown and described an embodiment in accordance with the present invention, it is understood that the same is not limited thereto but is susceptible of numerous changes and modifications as known to a person skilled in the art, and we therefore do not wish to be limited to the details shown and described herein but intend to cover all such changs and modifications as are obvious to one of ordinary skill in the art.

What is claimed is:

1. A puffer type gas circuit breaker comprising:

at least a pair of puffer type breaking units having their movable parts disposed to face each other, each breaking unit including:

at least a pair of contacts capable of being opened and separated from each other, and a puffer device having a puffer cylinder and a puffer piston, said puffer device being disposed so that when said contacts are opened and separated, said puffer device compresses an arc-extinguishing gas and blows it to an arc produced between said contacts;

a bracket disposed between said puffer type breaking units;

electrically insulating and supporting means for supporting said bracket in state electrically insulated from ground potential;

linking means mounted on said bracket to transmit an actuating force to each of the movable parts of said puffer type breaking units;

an electrically insulated operating rod for connecting said linking means with operating means disposed at ground potential in the insulated state;

supporting means for supporting each of said puffer type breaking units to said bracket;

insulating connecting means for connecting the movable parts of the puffer type breaking units with said linking means in the insulated state;

an electromagnetic coil attached in the insulated state to said bracket to form a series connecting circuit with each of said puffer type breaking units;

an electromagnetic repulsive member electromagnetically connected to said electromagnetic coil and arranged to actuate said linking means to open said puffer type breaking units in proportion to the intensity of an electric current flowing through said electromagnetic coil;

and current transferring means mounted on said puffer type breaking units to short-circuit said electromagnetic coil at closing positions of said puffer type breaking units and to release the short circuit at the initial stage of the breaking operation.

2. A puffer type gas circuit breaker as set forth in claim 1, wherein said current transferring means include:

an insulator formed on the peripheral portion of the puffer cylinder and providing a contact area, and a contact element having a contacting portion that can be contacted with and separated from the contact area of the puffer cylinder and also having on the inner face thereof a second insulator which is disposed to face said first insulator formed on the puffer cylinder with a prescribed clearance therebetween when the puffer type breaking unit is opened.

3. A puffer type gas circuit breaker as set forth in claim 1, wherein said current transferring means include:

a contact being contacted with a puffer cylinder shaft for driving said puffer cylinder and being electrically connected with said bracket, a first insulator mounted on the periphery of said cylinder shaft, and a second insulator mounted on a stand to which said contact is attached, said second insulator being arranged so that said second insulator faces said first insulator with a prescribed clearance therebetween when the puffer type breaking unit is opened.

4. A puffer type gas circuit breaker as set forth in claim 1, wherein said electromagnetic coil is mounted on the bracket on the side facing said electrically insulating and supporting means.

5. A puffer type gas circuit breaker as set forth in claim 4, wherein guide means are disposed so that the electromagnetic repulsive member electromagnetically connected with the electromagnetic coil can be moved while keeping a prescribed clearance from said electromagnetic coil.

6. A puffer type gas circuit breaker as set forth in claim 1, wherein said electromagnetic coil is mounted on the bracket on the side of said electrically insulating and supporting means.

7. A puffer type gas circuit breaker as set forth in claim 6, wherein said electromagnetic repulsive member electromagnetically connected with said electromagnetic coil is fixed to a connecting member connecting said electrically insulated operation rod to said link means.

8. A puffer type gas circuit breaker comprising:

at least a pair of puffer type breaking units having their movable parts disposed to face each other, each breaking unit including:

at least a pair of contacts capble of being opened and separated, and a puffer device having a puffer cylinder and a puffer piston and being disposed so that when said contacts are opened and separated, said puffer device compresses an arc-extinguishing gas and blows it to an arc produced between said contacts;

a bracket disposed between said puffer type breaking units;

electrically insulating and supporting means for supporting said bracket in the state electrically insulated from ground potential;

linking means mounted on said bracket to transmit an actuating force to each of the movable parts of said puffer type breaking units;

an electrically insulated operating rod for connecting said linking means with operating means disposed at ground potential in the insulated state;

supporting means for supporting each of said puffer type breaking units to said bracket;

insulating connecting means for connecting the movable parts of the puffer type breaking units with said linking means in the insulated state;

an electromagnetic coil attached in thhe insulated state to said bracket to form a series connecting circuit with each of said puffer type breaking units;

an electromagnetic repulsive member electromagnetically connected to said electromagnetic coil and arranged to actuate said linking means to open said puffer type breaking units in proportion to the intensity of an electric current flowing through said electromagnetic coil; and current transferring means including an insulator formed on the peripheral portion of the puffer cylinder and having a contact area, and a contact element having a contacting portion that can be contacted with and separated from the contact area of the puffer cylinder and also having on the inner face thereof a second insulator which is disposed to face said first insulator formed on the puffer cylinder with a prescribed clearance therebetween when the puffer type breaking unit is opened.

* * * * *